US006088868A

United States Patent [19]

Cerveny

[11] Patent Number: 6,088,868

[45] Date of Patent: Jul. 18, 2000

[54] FOLDING COMPACT PUSH BROOM

[76] Inventor: William J. Cerveny, 743 E. Bell Rd. Suite 2-176, Phoenix, Ariz. 85022

[21] Appl. No.: 09/122,703

[22] Filed: Jul. 27, 1998

[51] Int. Cl.[7] ..... A46B 9/10

[52] U.S. Cl. ..... 15/144.3; 15/144.1; 15/172; 15/203; 15/176.2; 16/900; 81/489

[58] Field of Search ..... 15/172, 203, 144.1, 15/144.3, 144.2, 201, 159.1, 160, 210.1, 176.3, 165, 220.4, 176.2; 81/489; 16/900, 901, 429

[56] References Cited

U.S. PATENT DOCUMENTS

| | | | |
|---|---|---|---|
| 129,564 | 7/1872 | Hovey | 15/106 |
| 597,873 | 1/1898 | Beiderhase | 15/203 |
| 1,307,530 | 6/1919 | Wolf | 15/203 |
| 1,555,630 | 9/1925 | Brock | 15/172 |
| 1,689,109 | 10/1928 | Brock | 15/172 |
| 1,836,942 | 12/1931 | Sumi | 15/160 |
| 4,845,800 | 7/1989 | Pederson et al. | 15/228 |
| 5,004,239 | 4/1991 | Wettstein | 15/160 |

FOREIGN PATENT DOCUMENTS

| | | | |
|---|---|---|---|
| 542248 | 1/1932 | Germany | 15/144.1 |
| 2203932 | 11/1988 | United Kingdom | 15/228 |

*Primary Examiner*—Gary K. Graham
*Attorney, Agent, or Firm*—Crane Law Firm; Pamela J. Crane

[57] ABSTRACT

A cleaning implement such as a broom which has a head divided into multiple sections which are hinged together with a hinge that will remain in an open position. It also has a handle which is made in multiple sections, and which are hinged together.

2 Claims, 3 Drawing Sheets

FOLDING COMPACT PUSH BROOM

BACKGROUND OF THE INVENTION

This invention relates, in general, to brooms, and, in particular, to a broom that folds for compact storage.

DESCRIPTION OF THE PRIOR ART

In the prior art various types of brooms have been proposed. For example, U.S. Pat. No. 2,671,918 discloses a composite broom that has two faces, one horizontal and the other vertical, so that the broom can be used to clean two surfaces at the same time.

U.S. Pat. No. 4,339,838 discloses a squeegee having a retractable blade which can be moved into the blade housing when not in use.

U.S. Pat. No. 4,642,837 discloses a broom assembly with a removable ferrule which encloses and supports the bristles of the broom.

U.S. Pat. No. 4,882,802 discloses a broom for concrete work in which the handle can be mounted in a plurality of adjustable positions so the broom can be maneuvered into hard to reach places.

U.S. Pat. No. 4,908,900 discloses a cleaning tool for removing ice and snow and which has bristles which can be disposed perpendicularly or parallel to the handle.

U.S. Pat. No. 5,305,882 discloses a tool having a collapsible handle and a cover for covering and concealing the tool when the handle is collapsed.

While all of the prior art devices work for their intended purposes, none of the prior art patents address the problem of storing a large broom or other cleaning implement in a limited amount of space. Many people have such a problem such as truck drivers, apartment dwellers and people who work in warehouses. The present invention is designed to overcome these shortcomings in the prior art.

SUMMARY OF THE INVENTION

The present invention comprises a cleaning implement such as a broom which has a broom head that is divided into multiple sections which are hinged together with a hinge that will remain in an open position. It also has a handle which is made in multiple sections, and which are hinged together.

It is an object of the present invention to provide a new and improved foldable cleaning implement.

It is an object of the present invention to provide new and improved foldable cleaning implement that can easily be stored in a small space.

These and other objects and advantages of the present invention will be fully apparent from the following description, when taken in connection with the annexed drawings.

DESCRIPTION OF THE PREFERRED EMBODIMENT

Figure 1:
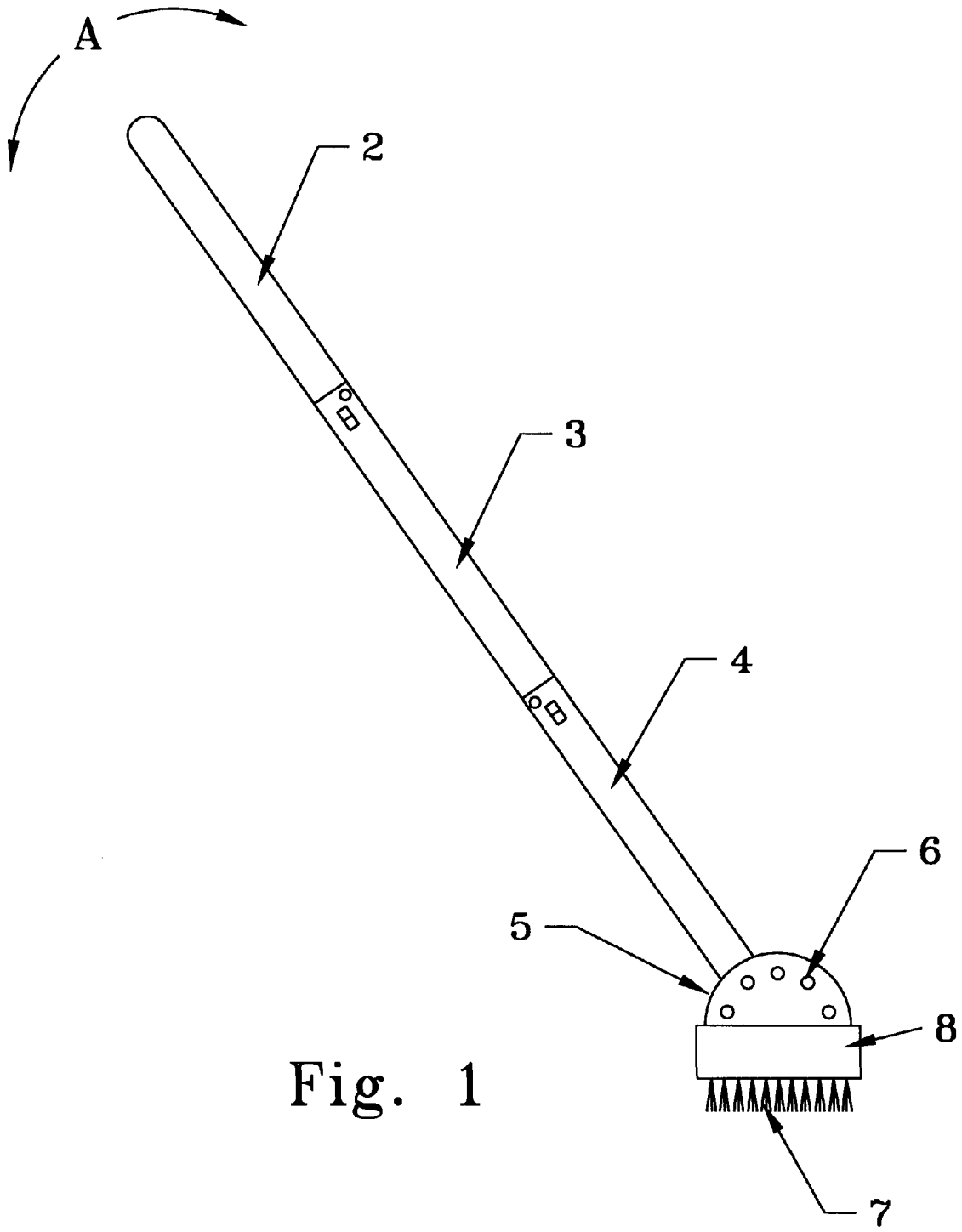
FIG. 1 is a side view of the present invention.
Figure 5:
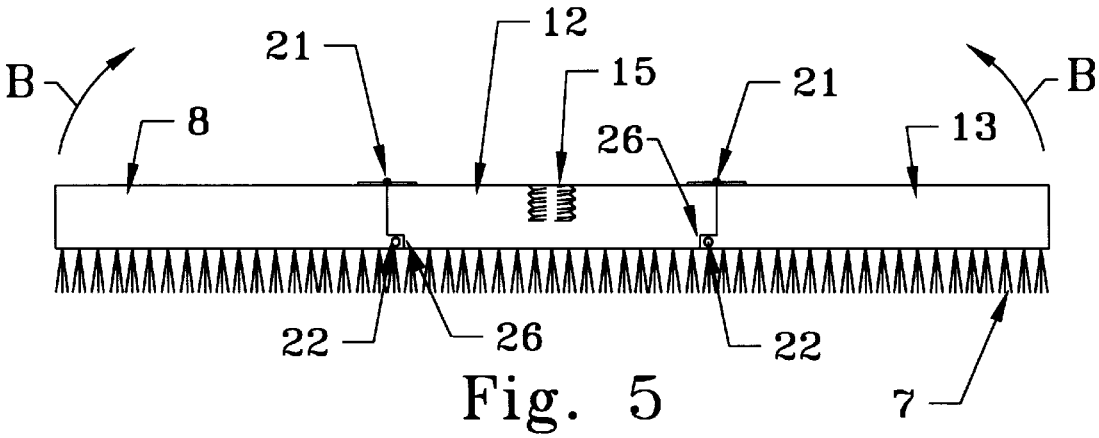
FIG. 5 is a front view of the body of the broom.
Figure 6:
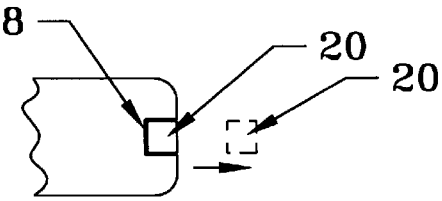
FIG. 6 is a partial view of the broom body locking mechanism.

Referring now to the drawings in greater detail, FIG. 1 shows the folding broom 1 of the present invention. The broom has a multi-section handle 2, 3, 4 which as will be explained below can separate for storage. The handle can be made from any conventional material such as, but not limited to, wood or plastic. The body of the broom 8, 12, 13 is also made in sections, as shown in FIG. 5, so it can be folded for storage. The broom sections 8, 12, 13 will have bristles 7 attached thereto by any conventional means.

Figure 2:
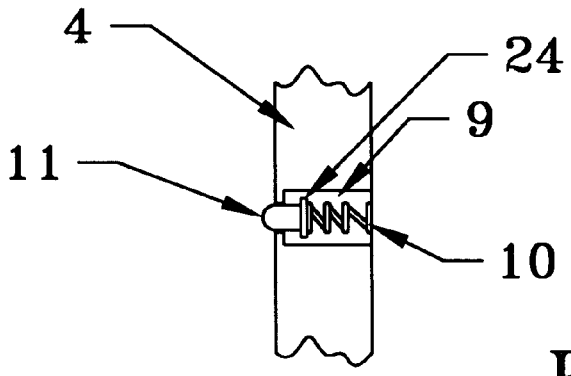
FIG. 2 is a partial view of the handle adjusting lock mechanism.

The broom handle can be adjusted with respect to the broom body by rotating the handle in the direction of the arrow as shown in FIG. 1. In order to adjust the broom handle, the handle section has a recess 9 (see FIG. 2). A spring 10 is positioned within the recess to bias a catch 11 out of the recess. The catch 11 has flanges 24 which will engage walls within the recess to keep the catch from being biased totally out of the recess.

Figure 3:
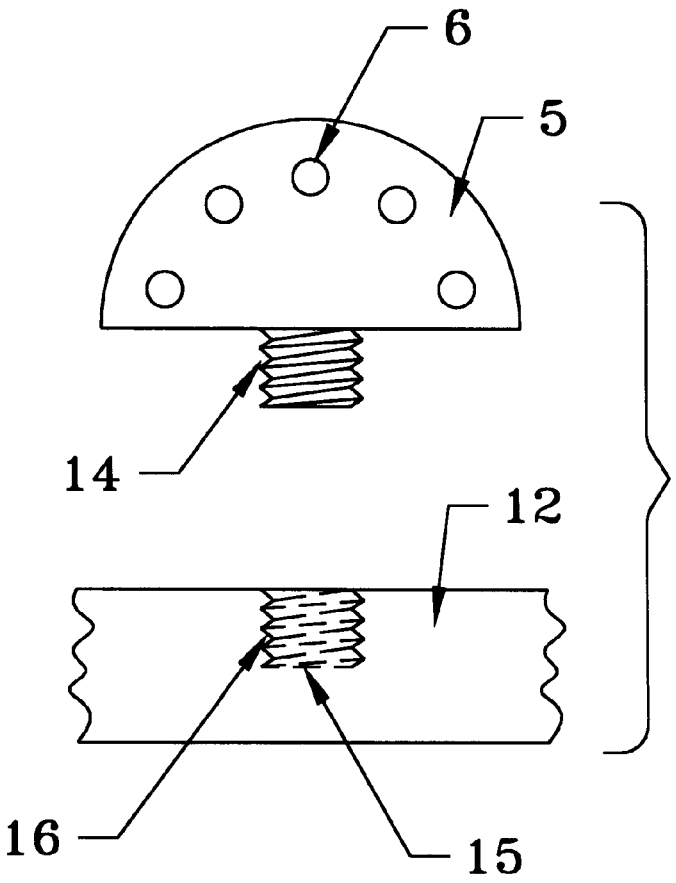
FIG. 3 is a partial view of the handle adjusting mechanism and how it is attached to the body of the broom.

As shown in FIG. 3, the broom body section 12 has a recess 15 which is provided with internal threads. The adjustment flanges 5 (only one of which is shown) straddle the end of the handle section 4, and have a plurality of apertures 6 therethrough. The spring biased catch 11 will engage one of the apertures in order to adjust the angle the handle makes with the body of the broom. In order to adjust the handle, a user will depress the catch 11 until it disengages from the aperture that it is in, move the handle to a new position and allow the spring 10 bias the catch 11 into a new aperture 6.

In order to secure the flange 5 to the broom body section 12, the flange 5 has a male threaded portion 14 with threads that cooperate with threads 16 within the recess 15 in the broom body section 12, as shown in FIG. 3.

Figure 4:
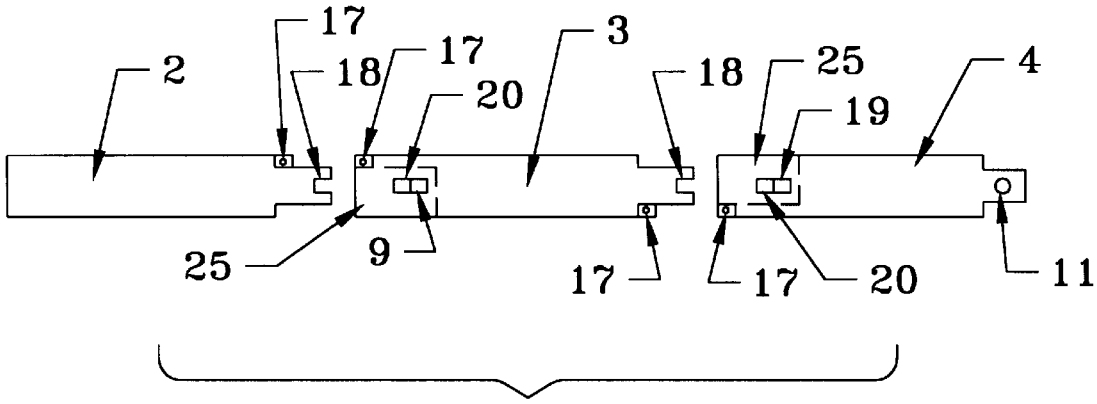
FIG. 4 is a view of the handle of the broom.

As shown in FIG. 4, the handle sections 2, 3, 4 can be folded with respect to each other. The section 2 has a male end with a slot 18 therein, and an aperture 17 positioned remote from the male end. The male end on section2 will fit into a female section 25 on the adjacent end of handle section3. When the two handle sections are joined the apertures 17 on the two handle sections will be aligned and a pin (not shown) will act as a hinge so the two handle sections can be pivoted with respect to one another for storage. The recess 25 is open to the bottom of section 3 (as seen in FIG. 4) so the end with the slot 18 can pivot about the pin in aperture 17.

In order to prevent the two handle sections from pivoting when the broom is in use, the slot 18 on the male end will engage a slide 20 which projects into the recess 25. The slide 20 can move from one side of the slot 19 to the other. When the male end is engage in the recess 25 and the slide is to the left. as shown in FIG. 4, the slide will be engaged with the slot 18 and the handle section 2 will be prevented from pivoting with respect to the handle section3. When the slide 20 is moved to the right of the slot 19, the slide will be out of the slot 18 and the handle section 2 will be able to pivot with respect to the handle section 3. The handle sections 3 and 4 are joined in the same manner and, therefore, a description of them is not necessary.

The broom body sections 8, 12, 13 will also fold one upon the other for storage. As seen in FIG. 5, the broom body sections are hinged together by any conventional hinge 21, so the sections 13 and 8 can pivot in the directions of the arrows B for storage. In order to prevent the sections from pivoting when the broom is in use, sections 8 and 13 have a male tab 26 which fits into a complimentary recess on the section 12. A snap catch 22 of any conventional design will hold the male tab26 engaged with the complimentary recess to prevent the broom body sections 8, 12, 13 from pivoting with respect to each other when the broom is in use.

Also, it should be noted that the present invention has been described as a broom, however, other cleaning implements such as a dust mop or wet mop could also be used instead of a broom. In addition, the broom handle and the broom body has been describe as each having three sections, however, they may be composed of fewer or more sections without departing from the scope of the invention.

Although the Folding Compact Push Broom and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A cleaning implement comprising:

A main section in at least one other section, each of said sections having a surface with cleaning means thereon, said main section being secured to said at least one other section by a first hinge means for allowing said at least one other section to be folded onto said main section;

A handle attached to said main section;

said handle having at least two separate handle sections secured by a second hinge means to allow said at least two handle sections to be folded against each other;

wherein one of said handle sections has a male end, said male end having a longitudinal slot therein, and an adjacent handle section has a female end wherein said male end fits into said female end;

said female end having a slide catch which is movable from a first position to a second position;

in said first position said slide catch engages said longitudinal slot to lock said handle sections together, and in a second position said slide catch does not engage said longitudinal slot, whereby said handle sections can move with respect to each other.

2. A cleaning implement comprising:

A main section and at least one other section, each of said at least one other sections having a surface with cleaning means thereon;

said main section being secured to said at least one other section by a first hinge means for allowing said at least one other section to be folded onto said main section;

At least one flange having a plurality of apertures therein, wherein said at least one flange has threads thereon for engaging with complimentary threads on said main section for securing said at least one flange to said main section;

handle attached to said main section;

said handle having at least two handle sections secured by a second hinge means to allow said at least two handle sections to be folded against each other;

wherein one of said handle sections has a spring-biased catch mounted thereon;

said spring-biased catch engages one of said apertures to hold said handle section in a first position with respect to said main section, and said spring-biased catch engages another of said apertures to hold said handle section in another position with respect to said main section.

* * * * *